United States Patent [19]

Torikai et al.

[11] 4,073,705

[45] Feb. 14, 1978

[54] METHOD FOR TREATING USED OR EXHAUSTED PHOTOGRAPHIC FIXING SOLUTION

[75] Inventors: Eiichi Torikai, Yao; Youji Kawami, Kawachinagano, both of Japan

[73] Assignee: Agency of Industrial Science & Technology, Tokyo, Japan

[21] Appl. No.: 731,687

[22] Filed: Oct. 12, 1976

[30] Foreign Application Priority Data

Oct. 20, 1975 Japan ..... 50-126749

[51] Int. Cl.[2] ..... C25B 1/00

[52] U.S. Cl. ..... 204/92; 204/128; 204/130

[58] Field of Search ..... 204/109, DIG. 9, 92, 204/128, 130

[56] References Cited

U.S. PATENT DOCUMENTS

| | | | |
|---|---|---|---|
| 1,534,709 | 4/1925 | Holt | 204/DIG. 9 |
| 2,451,341 | 10/1948 | Jernstedt | 204/DIG. 9 |
| 2,615,839 | 10/1952 | Willier | 204/109 |

*Primary Examiner*—R. L. Andrews

*Attorney, Agent, or Firm*—Armstrong, Nikaido & Marmelstein

[57] ABSTRACT

Removal of silver and reduction of COD value in used or exhausted photograhic fixing solution are effectively conducted by electrolysis of reversing repeatedly polarity of positive and negative electrodes.

2 Claims, 1 Drawing Figure

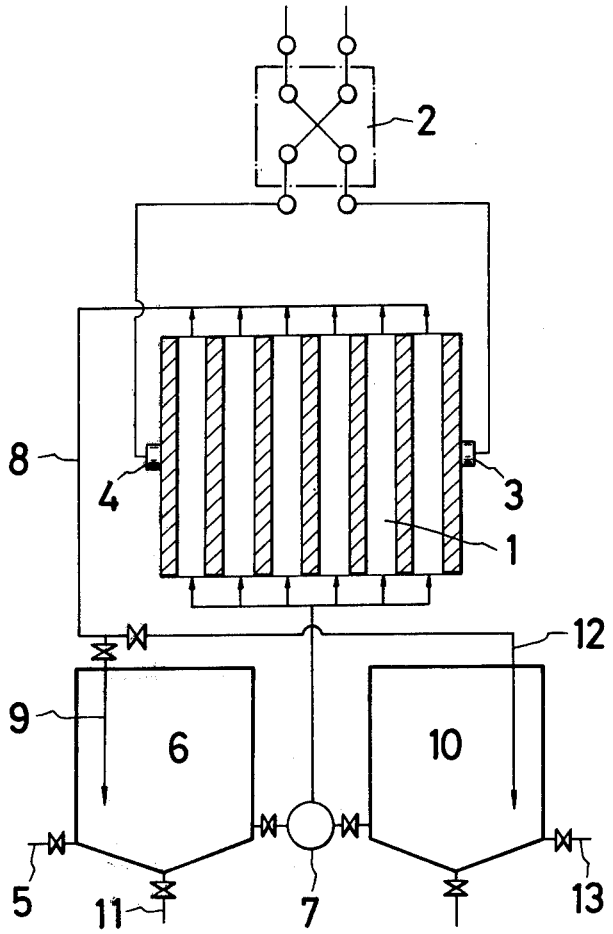
2
8
4
3
1
12
9
6
10
5
11
7
13

METHOD FOR TREATING USED OR EXHAUSTED PHOTOGRAPHIC FIXING SOLUTION

BACKGROUND OF THE INVENTION

The present invention relates to a method for treating used or exhausted photographic fixing solution and, more especially, to a novel and useful method of electrolysis treatment of used fixing solution by which silver ion contained in the solution is effectively removed as a precipitate of silver sulfide and simultaneously or thereafter COD value (Chemical oxygen demand) of the solution is effectively decreased.

Fixing solution, which is used in photographic processes, is gradually deteriorated by accumulating therein silver halide as soluble salts during use.

Therefore, in photographic laboratories or the like in which a large quantity of fixing solution is successively used, the used fixing solutions are usually recycled by removing silver component by means of desilvering (or silver removing) apparatus.

However, the waste water discharged from the photographic laboratories or hospitals, schools, research institutes, etc., in which a relatively small amount of the fixing solution is used, is usually containing silver halide and, moreover, the COD value of such a waste water is extremely high mainly due to sodium thiosulfate, which is one of the main components of the fixing solution, and it reaches, sometimes, 50,000–100,000 ppm. Accordingly, it has been required that the reduction of the COD value and the removal of silver are attained effectively each other.

The conventional method for treating the use fixing solution is a method in which sulfide, such as sodium sulfide, is added into the used fixing solution to precipitate and recover silver component in the solution as silver sulfide and then chlorine gas or hypochlorite solution is added thereto to decompose thiosulfate ion. As is clear from the above conventional meethod, in the known methods, silver-removing treatment and COD-lowering treatment are carried out separately, and accordingly, the known methods have various defects such as difficulty in operation and expensiveness of apparatus and running cost. Among the known methods, there is a method in which the used fixing solution is electrolyzed to recover silver component as metal silver. However, such a known electrolytic silver recovery can not attain reduction of COD value. Moreover, although the known electrolytic method is an effective silver-recovering method in case when the concentration of silver component in the solution is relatively high, it is difficult to recover metal silver of high purity in case when the concentration of silver component is less than 0.5 g/l. In this case, while metal silver is deposited, highly colloidal silver sulfide is also deposited simultaneously to cover over the surface of cathode and colloidal sulfur is also deposited to cover over the surface of anode. As a result, the bath voltage is gradually increased, the efficiency of electrolysis is gradually lowered and finally the continuation of electrolysis becomes impossible.

An object of the present invention is to overcome the problems and disadvantages of the conventional methods.

A further object of the present invention is to provide a method for carrying out effectively silver recovery and the reduction of the COD value is used fixing solution by means of quite simple apparatus and easy operation.

Other objects and advantages of the present invention will become apparent hereinafter.

SUMMARY OF THE INVENTION

The objects of the present invention may be achieved by electrolyzing the used fixing solution while repeatedly reversing polarity of positive and negative electrodes.

BRIEF DESCRIPTION OF THE DRAWING

FIG. 1 is a drawing showing one embodiment of apparatus used in the method according to the present invention.

DESCRIPTION OF THE PREFERRED EMBODIMENT

According to the present invention, the silver-removing treatment and the COD-lowering treatment of used fixing solution are achieved quite economically by turning on an electric current to the solution while converting polarity of anode and polarity of cathode by turns.

According to the present invention, the recovery of silver component from the used fixing solution is achieved by utilizing sulfide ion ($S^{2-}$) which is produced by electrolytic reduction of thiosulfate ion contained in the solution and, accordingly, addition of sulfide, which is necessary in the conventional method, is not required.

According to the present invention, addition of oxidizing agent such as alkali hypochlorite solution, which is necessary in the conventional method, is also not required in order to lower the COD value. Accordingly, the method of the present invention is quite economical. In the electrolytic treatment according to the present invention, polarity of the electrodes is reversed and, thereby, adhesion of colloidal silver sulfide produced by cathodic reaction is prevented to keep the surface of cathode always clean and deposition of above colloidal silver sulfide is promoted.

Therefore, the silver-removing treatment may be completely carried out in a short time. Moreover, in periodic reverse current, even the electrolysis of long time, sulfur does not deposit on the surface of anode at all and the bath voltage is not increased. Therefore, the COD-lowering treatment may be carried out with high efficiency.

As is mentioned above, according to the present invention, both of the silver-removing treatment and the COD-lowering treatment can be carried out simultaneously and effectively by only reversing polarity of electrodes and thereby silver sulfide can be recovered with high yield of about 99% from the used fixing solution and also the COD value of the solution can be remarkedly lowered.

In practicing the method according to the present invention, non-diaphragm type electrolytic bath provided with conventional electrodes such as graphite or titanium plated with platinum may be used. Capacity of the electrolytic cell and the number of electrodes can be decided in accordance with volume of the used fixing solution to be treated. According to the present invention, the silver-removing treatment and the COD-lowering treatment can be conducted by means of same electrolytic cell. The silver-removing treatment and the COD-lowering treatment may be conducted simultaneously by putting the used fixing solution in the electrolytic cell and then sending an electric current thereto while reversing polarity.

However, the COD-lowering treatment requires a longer period of time in comparison with the silver-removing treatment. Accordingly, sometimes, the used fixing solution is electrolyzed in a period of time sufficient to convert silver component existing in the solution to silver sulfide and then the remained solution or mother liquor is taken out from the electrolytic cell in order to separate colloidal silver sulfide contained in the solution by filtration, coagulation or the like, and again the remained solution of mother liquor is returned into the electrolytic cell in order to conduct the COD-lowering treatment. In the above method, a coagulating agent may preferably used in order to coagulate silver sulfide.

Preferably coagulating agents are conventional nonionic or anionic polymer coagulating agents. Examples of coagulating agents are nonionic coagulating agents such as polyacrylamide type and polyoxyethylene type and anionic coagulating agents such as poly (sodium-acrylate), salt of copolymer of maleic acid and salt of partially hydrolyzed product of polyacrylamide. The recovery of silver sulfide may also be conducted by various other conventional methods such as floating method. Although the method according to the present invention can be conducted using only one electrolytic cell, the method can also be conducted using two or more electrolytic cells which are connected eath other.

In this case, the silver-removing treatment and the COD-lowering treatment can be conducted in the individual electrolytic bathes and therefore a large amount of the used fixing solution can be treated continuously. In this case, mono polar cell system, in which terminals are attached to every other electrode, or bipolar cell system, in which voltage is charged to both terminals of electrodes, may be used as electric current sending method. In both cases, it is essential to reverse polarity of positive and negative electrodes repeatedly.

This reversing of polarity results in solution of the defects of known silver recovery methods and also results in lowering of the COD value.

By reversing polarity of electrodes repeatedly, colloidal silver sulfide produced by cathodic reaction and colloidal sulfur produced by anodic reaction are not adhered to the surface of electrodes and accordingly the surface of electrodes are kept always clean and the defects, such as increaing of bath voltage and lowering of electrolytic efficiency, are not brought about at all.

Hereinafter, the present invention is explained according to FIG. 1.

In FIG. 1, 1 indicates closed type electrolytic cell of non-diaphragm multiple pole system in which a plurality of graphite electrodes are used. At both terminal portions of the electrolytic cell 1, terminals 3, 4 connected to output terminals of direct current rectifier 2, which can reverse polarity at optional intervals, are provided. Used fixing solution is fed into storage tank 6 through pipe 5. The solution is transferred into electrolytic cell 1 by means of pump 7 to electrolyse.

The solution is preferably stirred during electrolysis. Therefore, according to the present invention, the solution is preferably recycled between electrolytic cell and storage thank through pipes 8, 9 and pump 7 during electrolytic treatment. The pH of the solution is preferably maintained in an alkaline condition in order to coagulate easily silver sulfide thus produced.

Therefore, alkaline substance such as sodium hydroxide of potassium hydroxide is preferably added into the solution prior to the electrolytic treatment. The addition amount of alkaline substance is decided so as to be satisfy the condition that sulfuric acid produced by electrolytic oxidation and the pH of the solution after silver-removing treatment becomes about 6–8. The above silver-removing treatment is preferably conducted under the conditions of a temperature of about ordinary temperature of about 50° C, current dencity of about 5–20 A/dm$^2$, more preferably about 5–10 A/dm$^2$ and polarity-reversing period of about 10 seconds to about 10 minutes, more preferably about 30 seconds to about 5 minutes. Although theoretical quantity of electricity for producing silver sulfide from waste fixing solution is farady/mol or 0.216 ampere × hour/g $Ag_2S$, electrolysis according to the present invention is conducted preferably using 20–50% excess of theoretical quantity of electricity to improve the state of precipitate of silver sulfide. Generally, production of silver sulfide proceeds in the condition of current efficiency of more than 90%, however, according to the present invention, the produced silver sulfide is easily coagulated and not remained on the surface of electrode by sending an electric current in excess so as to keep the current efficiency about 50–70%.

After the electrolytic silver-removing treatment, the waste solution is returned into the storage tank 6 and a coagulating agent is added thereto to deposit silver sulfide existing in the used solution. After precipitation of silver sulfide, supernatant liquid in the storage tank 6 is transferred to storage tank 10 by means of pump 7 and again transferred into the electrolytic cell 1 by means of the pump 7, and the interior of electrolytic cell is washed with an electric current sent across the cell, and the solution is returned into the storage tank 6 through pipes 8 and 9. The flocculent precipitation of silver sulfide in the storage tank 6 is taken out through pipe 11 and is filtered to recover $Ag_2S$.

After completion of such silver-removing treatment, the treated solution is transferred into storage tank 10 and then subjected to the COD-lowering treatment as follows.

The above treated solution is introduced into electrolytic cell 1 through pump 7 from storage tank 10 and subjected to the electrolytic treatment therein be reversing polarity. in this electrolytic treatment, the solution is preferably recycled by between electrolytic cell 1 and storage tank 10 through pipes 8, 12 and pump 7, just like in the electrolytic treatment for removing silver. The above electrolytic treatment is preferably conducted under the same conditions as those of the silver-removing treatment. For instance, the temperature is preferably about ordinary temperature to about 50° C, the current density is preferably about 5–20 A/dm$^2$m more preferably aboout 5–10 A/dm$^2$, and the polarity-reversing period is preferably about 10 seconds to 10 minutes, more preferably about 30 seconds to about 5 minutes.

By such a polarity-reversing electrolytic treatment, thiosulfate, sulfite ion, other sulfur compounds and a small amount of organic compounds are effectively oxidized and the COD value of the solution is remarkedly lowered without adhesion of colloidal sulfur onto the surface of anode.

Although the COD value of the used fixing solution is generally greater than 10,000 ppm, it may be lowered to about 1,000 ppm at current efficiency of about 80% and to about 500 ppm at current efficiency of about 65–75% according to the present invention. The end point of the electrolytic COD-lowering treatment may be qualitatively detected by observing a color-changing point when an iodine solution is gradually added into the treated solution sample.

After completion of the electrolytic COD-lowering treatment, the treated solution is returned into storage tank 10, a small amount of black precipitate produced by slight consumption of graphite electrodes, if any, may be filtered out, and then the remained solution may be discharged. In case of using titanium plated with platinum as electrode, above mentioned consumption of electrode is not recognized, and therefore the filtration is not necessary.

As is mentioned above, according to the polarity-reversing electrolysis of the present invention, the silver-removing treatment and the COD-lowering treatment are effectively carried out and consequently the used fixing solution is converted to the harmless solution and the environmental pollution is prevented. Moreover, the present invention contributes to the recovery and reutilization of silver sulfide resources.

Hereinafter, the present invention is explained in detail by the experimental result.

EXAMPLE 1

A used photographic fixing solution used for development of photographic film was subjected to the electrolytic treatment by using the electrolysis apparatus shown in FIG. 1.

The COD value of the used fixing solution measured by chromic acid method was 68,000 ppm. The used fixing solution contained following components.

Sodium thiosulfate: 200 g
Sodium sulfite: 10 g
Alum: 10 g
Silver halide: 10 g
Water: 1,000 g The bipolar electrolytic cell having four chambers, in which five pieces of graphite plates set in polyvinyl chloride's frame was joined together, was used.

The capacity of each chamber was 700 ml. 10 l of the used fixing solution were put in the storage tank 6, 1,100g of sodium hydroxide were added thereto and the electrolytic silver-removing treatment was conducted.

The conditions of the silver removing treatment were as follows.

electric current: 40 A
voltage: 18–20V
bath temperature: 40°–50° C
volume of recycled solution: 10 l/min.
polarity-reversing period: 1 min.

Although theoretical quantity of electricity for producing silver sulfide is 24.8 Ampere × hour/g treatment solution, the electrolysis in this Example was conducted by using quantity of electricity of 50 A.h (for about 20 minutes).

After electrolysis, the treated solution was transferred into the storage tank 6 and then a nonionic coagulating agent "Konan-flock Nonion 3000" (manufactured by Konan Chemical Industries Co.) was added until the concentration thereof become 0.005% to deposit silver sulfide. The supernatant liquid was transferred into the electrolytic cell through pump 7, the remained silver sulfide adhered on the inner surface was washed out by the above supernatant liquid and then the solution was again transferred into the storage tank 6. The suspended solution in the storage tank 6 was filtered out by means of suction filter.

Silver sulfide filtered out was dried at 60° C, Ag therein was measured by chemical analysis. The recovery of Ag from the used fixing solution was 98.5%.

The COD value of the remained solution was about 63,500 ppm.

The remained solution was returned into the storage tank 6 and then subjected again to electrolysis.

The conditions of this electrolytic COD-lowering treatment was as follows.

electric current: 40 A
voltage: 18–20V
bath temperature: 40°–50° C
volume of recycled solution: 15 l/min.
polarity-reversing period: 5 min.
quantity of electricity: 2,950 A.h (about 18.6 hrs.)

After the treatment, the COD value indicated 1,050 ppm and the current efficiency was about 76%.

The treated solution contained slightly black residue due to consumption of graphite electrode, however, this residue was easily filtered out.

What is claimed is:

1. A method for treating a used or exhausted photographic fixing solution containing silver and sulfur components in an electrolytic cell which comprises a. electrolyzing the solution for a period of time sufficient to convert the silver component to a silver sulfide precipitate while reversing the polarity of the electrodes,
b. separating the precipitate from the solution, and
c. electrolyzing the resulting solution to lower the COD value while repeatedly reversing the polarity of the electrodes, whereby the reversing of the polarity of the electrodes in steps (a) and (c) prevents the adherence of any colloidal silver sulfide or sulfur to the electrodes.

2. The method of claim 1 wherein a coagulating agent is employed.

* * * * *